US005184563A

United States Patent [19]

Hislop

[11] Patent Number: 5,184,563

[45] Date of Patent: Feb. 9, 1993

[54] MARINE PROPULSION APPARATUS

[76] Inventor: Douglas G. Hislop, 170 Hinds Street, West End, 4179, Qld., Australia

[21] Appl. No.: 654,640

[22] PCT Filed: Aug. 2, 1989

[86] PCT No.: PCT/AU89/00327

§ 371 Date: Feb. 11, 1991

§ 102(e) Date: Feb. 11, 1991

[87] PCT Pub. No.: WO90/01444

PCT Pub. Date: Feb. 22, 1990

[30] Foreign Application Priority Data

Aug. 11, 1988 [AU] Australia ..... PI9780

[51] Int. Cl.[5] ..... B63B 21/56

[52] U.S. Cl. ..... 114/251; 114/249

[58] Field of Search ..... 114/242, 251, 249, 246, 114/144 R, 248

[56] References Cited

U.S. PATENT DOCUMENTS

| | | | |
|---|---|---|---|
| 2,191,879 | 2/1940 | Dunajeff | 114/333 |
| 3,665,534 | 5/1972 | McIntyre | 114/343 |
| 3,890,920 | 6/1975 | Buelk | 114/315 |
| 3,892,195 | 7/1975 | Janssen | 114/249 |
| 4,080,921 | 3/1978 | Freitag | 114/249 |
| 4,169,423 | 10/1979 | Laskey | 114/251 |
| 4,453,487 | 6/1984 | Vinnari | 114/249 |
| 4,911,094 | 3/1990 | Akers | 114/249 |

*Primary Examiner*—Joseph F. Peters, Jr.
*Assistant Examiner*—Clifford T. Bartz
*Attorney, Agent, or Firm*—Helfott & Karas

[57] ABSTRACT

Marine propulsion apparatus comprising an engine mounted within a buoyant enclosure, which is adapted to be connected to a marine vessel, which requires propulsion. The engine drives a propeller through a simple drive system. The apparatus is adapted to be fitted into position on pivotal mountings for steering purposes, and may itself be fitted with steering apparatus such that it may be maneuvered independently of the marine vessel for positioning relative to it. The enclosure is sized to permit access around the engine for in-situ maintenance and repair.

9 Claims, 3 Drawing Sheets

MARINE PROPULSION APPARATUS

This application corresponds to the Australian application PCT/AU89/00327 which is pending.

This invention relates to marine propulsion apparatus and methods.

This invention has particular but not exclusive application to the propulsion of boats and barges, and for illustrative purposes reference will be made to such application. However, it is to be understood that this invention could be used in other applications, such as ships and hovercraft. For the purposes of this specification, the term "boat" is to be taken to refer to any marine craft of any type, including the abovementioned marine craft.

Marine propulsion is normally accomplished by driving a fully-submerged horizontal-axis propeller by a prime mover such as an internal combustion engine, a steam engine or an electric motor. If the prime mover or engine is mounted within the boat, it is usually mounted in line with the propeller axis, and the boat must be tapered inward at the rear to allow water to flow into the propeller. As a consequence of these requirements, considerable space within the boat can be lost to the prime mover, and access to the engine for removal or maintenance is frequently limited. Separate steering means must also be provided, usually in the form of a rudder.

An alternative propulsion concept is the outboard motor, in which a high-mounted engine and a low-mounted propeller are mounted on a common frame which swings about a vertical pivot on the rear of a boat to provide steering. The engine and the propeller must be coupled by a transmission system, and such transmission systems can be complex, expensive and difficult to maintain. As the outboard motor has minimal self-buoyancy and is overhung on the rear of the boat, it can seriously compromise the trim of a boat to which it is fitted. High-powered outboard motors of the type which may be used to propel heavy barges and the like are very heavy and require the application of cranes for their attachment or removal.

In the case of marine vessels such as barges, which may spend a considerable portion of their time stationary, tugs may be utilised to move them as necessary. While such a process is less wasteful in terms of the numbers of prime movers necessary for a fleet of barges, there are also problems with them. A tug must be built as a stand-alone boat with crew accommodation and must be large enough to possess sea-keeping capabilities consistent with its operating environment. Thus the cost per prime mover for tug power is quite high.

There are also frequently problems coupling tugs to barges. If a tug is coupled to a barge with ropes, both vessels can respond individually to wave action, but the ability of the tug to steer the barge is low. If a tug is coupled to a barge by a vertical pivot or a rigid coupling, the steering performance is greatly enhanced, but wave action on the tug hull loads the interface to a high degree.

The present invention aims to alleviate the above disadvantages and to provide propulsion apparatus which will be reliable and efficient in use. Other objects and advantages of this invention will hereinafter become apparent.

With the foregoing and other objects in view, this invention in one aspect resides broadly in unmanned marine propulsion apparatus adapted for outboard connection to a vessel whereby the vessel may be propelled along a body of water, said unmanned marine propulsion apparatus including:

marine propulsion means;

a prime mover for driving said propulsion means;

drive means connecting said prime mover to said propulsion means;

a buoyant enclosure capable of supporting said prime mover and said propulsion means with the latter disposed in driving engagement with the body of water, said enclosure having an underwater portion in which said prime mover and said drive means are located and an upwardly extending above-water portion having a relatively small water plane sectional area, and connecting means on said enclosure for connecting said unmanned marine propulsion apparatus to a vessel.

Preferably, the connecting means restrains the unmanned marine propulsion apparatus and the vessel to which it is connected from relative movement about a transverse axis therebetween whereby buoyancy loads are transferred between said unmanned propulsion apparatus and the vessel.

Preferably, the connecting means includes a vertical steering pivot about which the enclosure may pivot relative to the boat such that the boat may be steered by pivoting the enclosure, and steering actuation means, such as a steering actuator, may be disposed between the enclosure and the boat for pivoting the enclosure. Of course, if desired, other enclosure mounting means, such as rigid attachment means, may be used if desired. Directional control means such as a rudder or a propeller nozzle may be pivotally attached to the enclosure for pivotal movement about a substantially vertical axis such that steering of the boat may be accomplished independently of movement of the enclosure, or for enhancing maneuverability of a boat to which the enclosure is pivoted.

The propulsion means may include water jets or the like, but preferably the propulsion means includes a screw propeller for simplicity. The prime mover may be mounted in the enclosure with its output shaft axis substantially coaxial with the propeller axis such that a straight drive shaft may be used for economy and simplicity. Of course, if desired, other configurations of drive means such as Z-drives, chain drives or gear drives may be used. If desired, the prime mover may include a reduction and/or reversing gearbox for controlling propeller speed and direction, and may advantageously include a thrust bearing for absorbing thrust from the propeller.

The prime mover may be of any desired type, such as an electric motor, a hydraulic motor or a steam engine. It is preferred, however, that the prime mover include an internal combustion motor whereby minimal auxiliary prime mover apparatus need be added to the boat. If desired, auxiliary apparatus such as a fuel tank for the engine, a bilge pump for the enclosure, enclosure ventilation apparatus, and motor cooling apparatus may be include in the propulsion apparatus such that the latter may be substantially self-contained and may be operated independently of the boat if desired.

The prime mover may also include transmission means including gearing for speed-matching a desired motor to a desired propeller, a clutch for disengaging the drive and reverse-drive gearing for selecting forward or reverse drive. Suitably, the transmission means is in the form of a standard marine transmission closecoupled to the motor such that standard components may be utilised, that the length of the prime mover may be minimised, and that its thrust bearing may be utilised for transferring propulsion loads to the enclosure. Suitably, the prime mover and/or the marine transmission is provided with remote control means whereby it functions may be controllable from the boat.

The enclosure may be free-flooding if desired, and may be utilised in conjunction with a waterproof prime mover. Preferably, however, the enclosure is formed as a substantially watertight enclosure having all significant openings above the expected operating water immersion level such that a standard prime mover may be utilised and such that the displacement of the enclosure may provide hydrostatic support for the propulsion apparatus. The underwater portion and the above-water portion of the enclosure are preferably of substantially identical horizontal cross-section whereby displacement changes for the enclosure due to vertical movement of the boat may be minimised. It is also preferred that the enclosure be substantially tear-drop-shaped in horizontal section throughout the underwater and above-water sections for minimal fluid drag during movement in water. The prime mover may be disposed substantially medially in the enclosure and the longitudinal side wall section may be flattened and pass closely adjacent to the prime mover such that the horizontal cross-section of the enclosure is minimised whereby buoyancy change with depth of immersion may be minimised. If desired the longitudinal side walls may be spaced from the prime mover a distance sufficient to permit physical access to the opposed sides of the prime mover for in-situ maintenance and repair. Walkways may be provided extending between the prime mover and the side walls to facilitate such access.

The above-water portion may be formed with minimal clearance above an operating water level, but it is preferred that the height of the above-water portion be sufficient to maintain the upper end thereof above water when the propulsion apparatus is connected to a laden vessel, such that air vents for supplying air to the prime mover may be formed thereon, whereby an air-consuming prime mover may operate simultaneously. The air vents and any other access openings external to the enclosure may be provided with closure means such as covers or flaps for excluding the ingress of water when the propulsion apparatus is not operating.

If desired, the enclosure may be formed of a displacement and shape such that it may float independently of the boat as a stable marine vessel whereby it may be placed in attachable juxtaposition to a boat with minimal requirement for heavy lifting equipment. The enclosure may include ballast placed in any desired portion thereof for adjusting the weight or load distribution of the propulsion apparatus. The enclosure may be formed with clearance between selected portions of its inner surface and the prime mover such that a maintenance access space is formed around the latter such that it may be maintained or repaired without compromising the watertight state of the enclosure.

The enclosure may be provided with vertical adjustment means such as slides such that the height of the propulsion apparatus may be adjusted relative to the boat whereby the position of the propeller relative to the surface of the water may be adjusted to a desired value during variations in the loading condition of the boat. A vertical adjustment actuator disposed between the propulsion apparatus and the boat may be provided for adjusting the height of the propulsion apparatus relative to the boat.

The enclosure may also include buoyancy control means, such as a water ballast tank and a pump whereby the displacement of the propulsion apparatus may be selectively varied such that the latter may be brought into vertical alignment with a boat during the attachment process.

In another aspect, this invention resides in a method of propelling a vessel including:

providing an unmanned marine propulsion apparatus as defined above;

floating said unmanned marine propulsion apparatus to the vessel;

connecting said enclosure to the vessel, and operating said prime mover to propel the vessel.

In order that this invention may be more easily understood and put into practical effect, reference will now be made to the accompanying drawings which illustrate a preferred embodiment of the invention, wherein.

Figure 1:
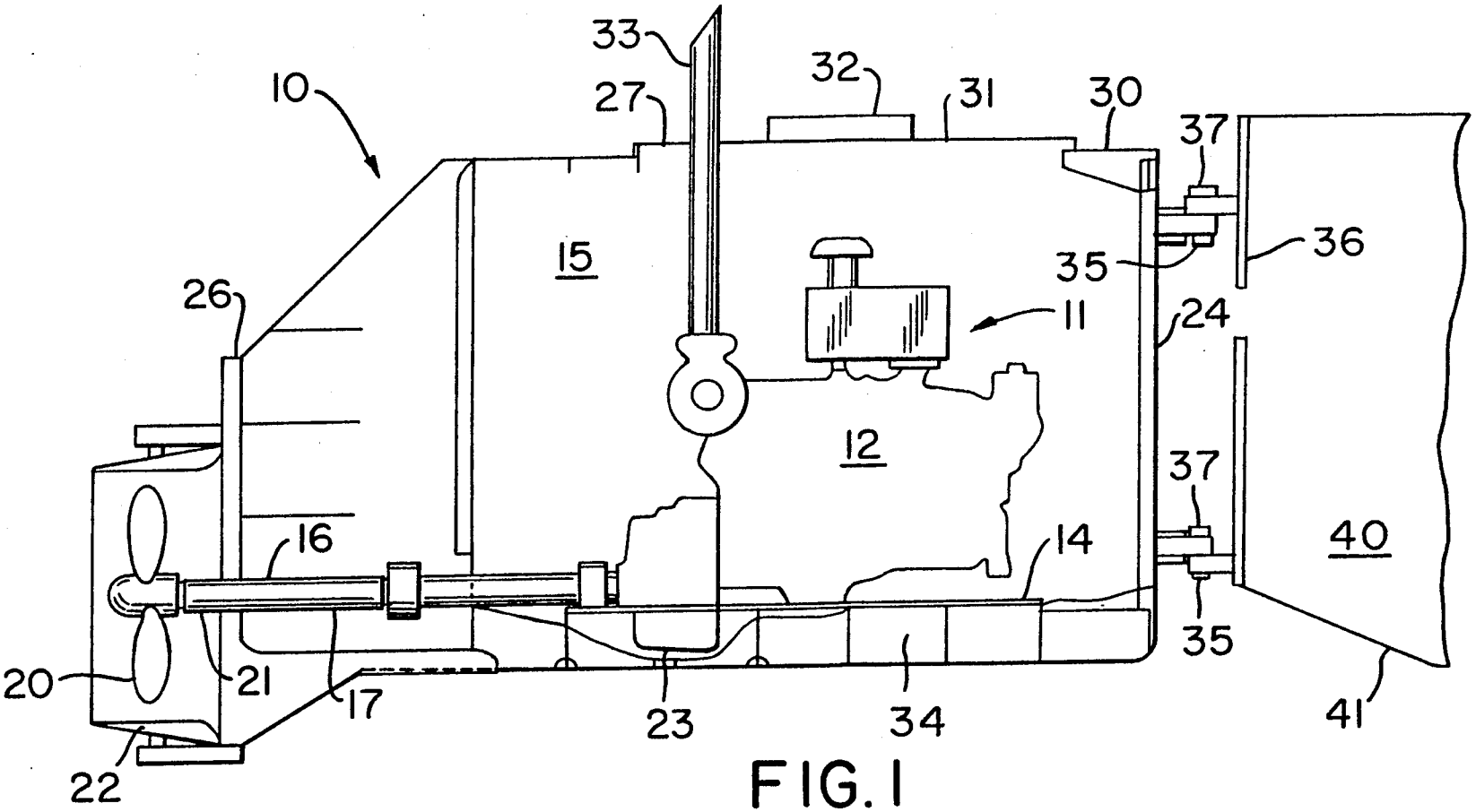
FIG. 1 is a sectional side view of a marine propulsion apparatus according to the invention.
Figure 2:
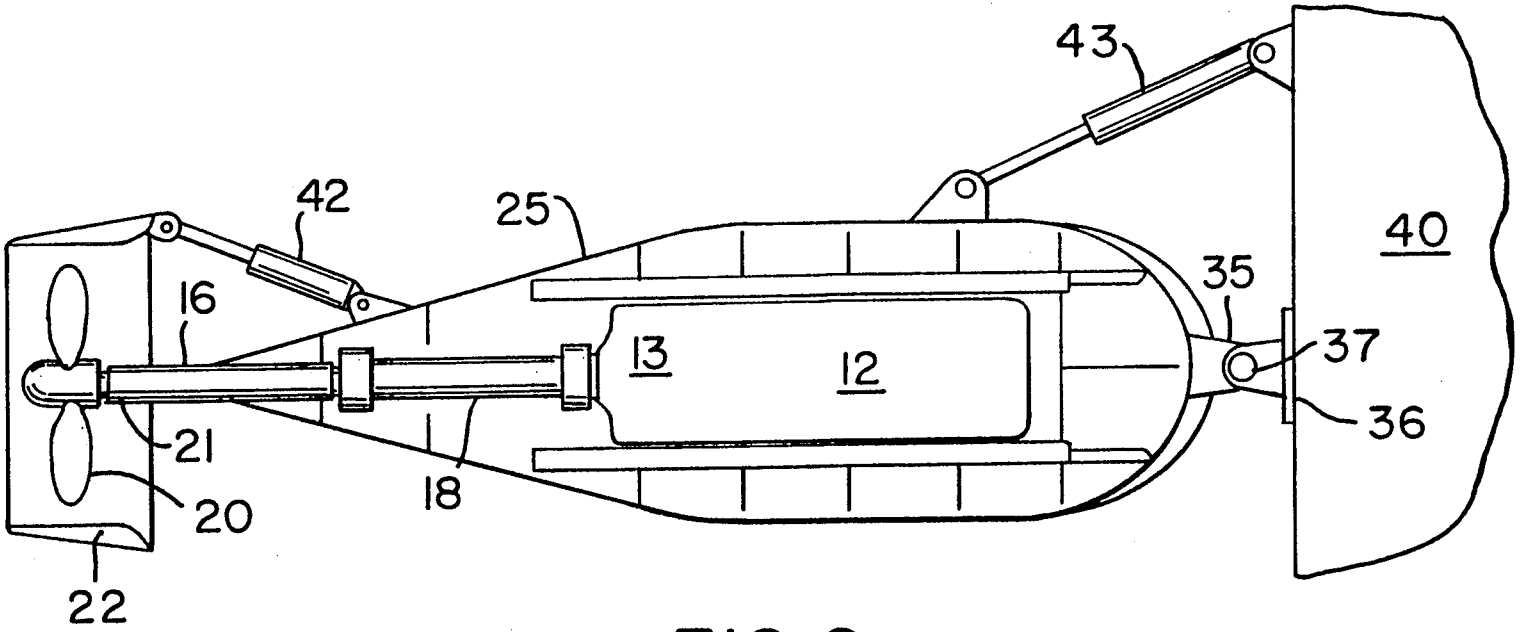
FIG. 2 is a top view of the marine propulsion apparatus of FIG. 1.
Figure 3:
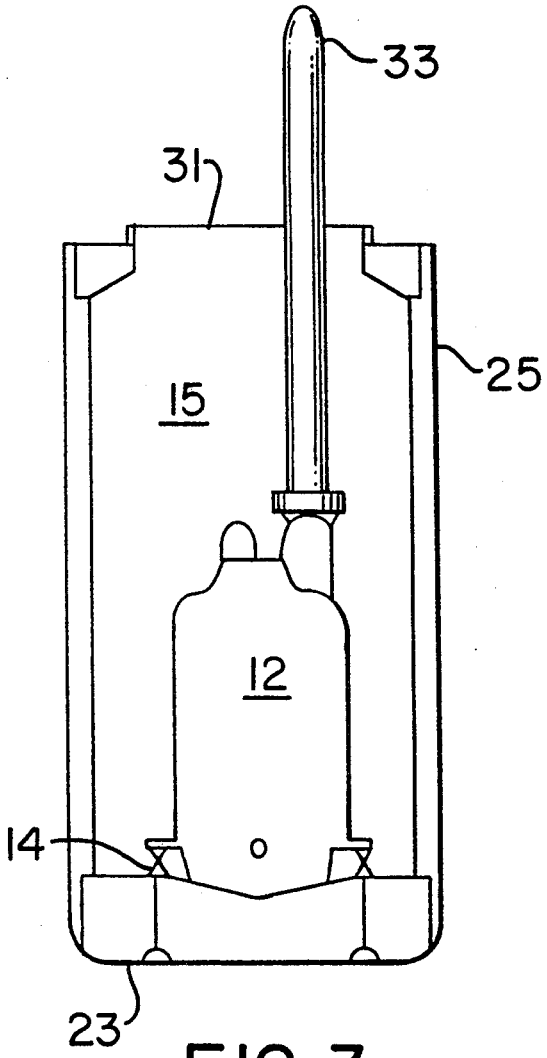
FIG. 3 is a rear view of the marine propulsion apparatus illustrated in FIGS. 1 and 2.

As shown in FIGS. 1, 2 and 3, the marine propulsion apparatus 10 includes a prime mover assembly 11 comprising an internal combustion motor 12 and a marine transmission 13 supported on mounting rails 14 within an enclosure 15. A stern tube 16 projecting from the rear of the enclosure supports a propeller shaft 17 for rotational motion therein, and is coupled to the marine transmission 13 by a cardan shaft 18. The propeller shaft 17 supports a propeller 20 at its rear end. A shaft seal 21 minimises ingress of water into the enclosure 15 through the stern tube 16. A nozzle 22 mounted about the propeller 20 enhances its thrust under particular operating conditions and is pivoted to the enclosure 15 at upper end and lower portions permitting it to be swivelled sideways for steering the propulsion apparatus 10.

The enclosure 15 is formed with a flat base 23 for stable support of the propulsion apparatus 10 while in storage, or during transport, such as on a truck. The front wall 24 of the enclosure 15 is formed as a smooth curve for minimising hydrodynamic drag, and the side walls 25 taper to a chisel-like vertical edge 26 at the rear of the enclosure for minimising resistance to water inflow to the propeller 20.

An access aperture 27 of sufficient size to permit removal or replacement of the prime mover assembly 11 is formed in the top wall 30 of the enclosure, and in operation is covered by a splash-proof cover 31. An air intake 32 and an aperture for an exhaust pipe 33 are also formed in the cover 31. Concrete ballast 34 is placed beneath the prime mover assembly 11 for adjusting the weight and balance of the propulsion apparatus 10.

Attachment pivots 35 are attached to the front wall 24 and may be coupled to a boat bracket 36 by pivot pins 37. The boat bracket 36 may be formed integral with a boat 40, or attached permanently or temporarily to a boat which may require the addition of propulsion apparatus. Preferably the boat bracket 36 is fitted to the boat 40 at a height such that the flat base 23 is flush with or above the keel 41 of the boat 40 such that the draught of the powered vessel is no greater than that of the unpowered vessel. A nozzle steering actuator 42 is connected between the nozzle 22 and the enclosure 15 to swivel the latter transversely for steering purposes.

The propulsion apparatus 10 may be installed by lowering it into the water and floating it into position with the attachment pivots 35 aligned with the boat bracket 36. The pivot pins 37 are then fitted. A steering actuator 43 is then connected, along with control cables (not shown), and the propulsion apparatus 10 is ready for use. If the propulsion apparatus 10 must be transported to the boat 40, it may be operated independently as a boat by controlling the motor 12 locally and steering the enclosure 15 locally using the nozzle actuator 42.

It will of course be realised that while the above has been given by way of illustrative example of this invention, all such and other modifications and variations thereto as would be apparent to persons skilled in the art are deemed to fall within the broad scope and ambit of this invention as is defined in the appended claims.

I claim:

1. Buoyant marine propulsion apparatus of the type which may be self-propelled or floated towards a vessel for outboard connection thereto and comprising a buoyant enclosure, propulsion means including a prime mover within the buoyant enclosure and associated propelling means external of the buoyant enclosure, connection means for connecting the buoyant enclosure to the vessel, and remote control means for remotely controlling the apparatus, wherein:

(a) said buoyant enclosure is narrow in an athwartships direction relative to a height and a length thereof, and is stabilized by ballast;

(b) said propelling means includes a propeller, and a thrust directing means associated with said propeller;

(c) said connection means includes a pivotal connection including a pivot pin assembly associated with said enclosure and adapted to engage pivotal mountings on the vessel for pivotal transverse movement of said enclosure about a fixed pivot axis defined by said pivotal mountings whereby the vessel may be steered by pivoting the enclosure about said fixed pivot axis; and (d) said remote control means includes a steering control for controlling pivotal movement of the buoyant enclosure about said fixed pivot axis.

2. Buoyant marine propulsion apparatus according to claim 1, wherein said propelling means is in the form of a marine propeller external of said buoyant enclosure and adapted to apply thrust along a longitudinal axis of the buoyant enclosure.

3. Buoyant marine propulsion apparatus according to claim 2, wherein said prime mover comprises an internal combustion engine and said marine propeller is driven by said engine via a shaft passing through an aperture provided in said enclosure.

4. Buoyant marine propulsion apparatus according to claim 3, wherein said directing means includes one of a rudder and a propeller nozzle pivotally attached to said enclosure for pivotal movement about a substantially vertical axis.

5. Buoyant marine propulsion apparatus according to claim 1, wherein at least most of said ballast is provided by said propulsion means.

6. Buoyant marine propulsion apparatus according to claim 1, wherein said buoyant enclosure and said propulsion means in assembly are of low mass relative to that of said vessel and a horizontal cross section of said enclosure above its waterline in use is no greater than the horizontal cross section below the waterline, so that pitching forces about said connection means may be minimized.

7. Buoyant marine propulsion apparatus according to claim 6, wherein said horizontal sections above and below the waterline in use are substantially tear-drop shaped.

8. Buoyant marine propulsion apparatus according to claim 1, wherein said connecting means provides a substantially vertical steering axis and said steering control means comprises a steering actuator connected between said enclosure and the vessel.

9. A method of steerably propelling a vessel, comprising the steps of:

a) providing a buoyant marine propulsion apparatus comprising a buoyant enclosure, propulsion means including a prime mover within the buoyant enclosure and associated propelling means external of the buoyant enclosure, connection means for connecting the buoyant enclosure to the vessel, and remote control means for remotely controlling the apparatus, wherein:

said buoyant enclosure is narrow in an athwartships direction relative to its height and length and is stabilized by ballast, said propelling means includes a propeller, and a thrust directing means associated with said propeller;

said connection means includes a pivotal connection including a pivot pin assembly associated with said enclosure and adapted to engage pivotal mountings on the vessel for pivotal transverse movement of said enclosure about a fixed pivot axis defined by said pivotal mountings so that the vessel may be steered by pivoting the enclosure about said fixed pivot axis, and said remote control means includes a steering control for controlling pivotal movement of the buoyant enclosure about said fixed pivot axis;

b) floating said buoyant marine propulsion apparatus to the vessel;

c) connecting said enclosure to the vessel; and d) remotely operating said remote control means to propel the vessel.

* * * * *